United States Patent [19]

Balko

[11] 4,294,671

[45] Oct. 13, 1981

[54] HIGH TEMPERATURE AND LOW FEED ACID CONCENTRATION OPERATION OF HCL ELECTROLYZER HAVING UNITARY MEMBRANE ELECTRODE STRUCTURE

[75] Inventor: Edward N. Balko, Wilmington, Mass.

[73] Assignee: General Electric Company, Wilmington, Mass.

[21] Appl. No.: 149,619

[22] Filed: May 14, 1980

[51] Int. Cl.[3] ..... C25B 1/26; C25B 9/00

[52] U.S. Cl. ..... 204/128; 204/263; 204/266

[58] Field of Search ..... 204/98, 128, 266, 263–265, 204/282–283

[56] References Cited

U.S. PATENT DOCUMENTS 4,056,452 11/1977 Campbell ..... 204/258

4,057,479 11/1977 Campbell ..... 204/258

4,191,618 3/1980 Coker et al. ..... 204/98

*Primary Examiner*—R. L. Andrews

*Attorney, Agent, or Firm*—I. David Blumenfeld

[57] ABSTRACT

An HCl electrolyzer utilizing a membrane with catalytic electrodes physically bonded to the surfaces of the membrane is provided with an electron current conducting structure which comprises an array of individual current conducting elements contacting the electrode. The cell is operated at high temperatures (60°–90° C.) to take advantage of the reduction of electrode overpotential at these temperatures but with low feed acid concentrations (≦9M) to minimize hydrogen chloride in the chlorine, i.e, HCl vapor pressure is below 0.1 atmospheres—76 Torr. There is also a large decrease in membrane resistance as temperature is increased. Simultaneously $O_2$ evolution is suppressed to maintain $O_2$ content in the chlorine at 0.1% or less.

13 Claims, 3 Drawing Figures

HIGH TEMPERATURE AND LOW FEED ACID CONCENTRATION OPERATION OF HCL ELECTROLYZER HAVING UNITARY MEMBRANE ELECTRODE STRUCTURE

The instant invention relates to a process and apparatus for the electrolytic production of halogens from aqueous halide solutions. More particularly, it relates to the electrolysis of aqueous HCl solutions at high temperatures and low feed acid concentrations.

BACKGROUND OF THE INVENTION

The production of chlorine by the electrolysis of aqueous solutions of halides in a cell comprising a permselective membrane having a conductive, catalytic electrode permanently affixed to the surface thereof and in physical contact with an external electron current distributor is described in an Application for U.S. Letters Patent Ser. No. 000,491, filed Jan. 2, 1979, now U.S. Pat. No. 4,247,376, issued Jan. 27, 1981 a division of Ser. No. 866,299, filed Jan. 3, 1978, now abandoned, in the names of Russell Mason Dempsey et al assigned to the General Electric Company, the assignee of the present invention. Cells of this type include a graphite electron current distributor which contacts the surface of the catalytic electrode bonded to the membrane. Such electron current collectors have a plurality of elongated, continuous, parallel ribs extending from a conductive base. The elongated ribs contact the catalytic electrode to distribute current while the channels formed between the ribs provide fluid distribution channels for the anolyte entering the cell as well as for gases evolved at the electrode. Continuous ribs may have the disadvantage of obstructing a relatively large area of the electrode thereby limiting access of the aqueous anolyte to the electrode at these locations. Because of the obstruction or "blinding" of areas of the bonded electrode, chloride ion starvation under these areas can result in electrolysis of water and the evolution of oxygen.

Coevolution of oxygen at a chlorine anode has a number of practical consequences, all of them undesirable. The evolution of oxygen, of course, represents a process inefficiency and increases the electrical cost necessary for producing chlorine, i.e., increases the production cost of chlorine. High oxygen levels also result in severe corrosion of graphite cell components. As pointed out previously, in an HCl electrolysis cell having anode electrodes bonded directly to an ion exchanging membrane, the preferred current collector fluid distributor is a molded graphite-polymer-aggregate having a plurality of parallel grooves which contact the electrode provide current to the electrodes while distributing the anolyte and the electrolysis product at the anode. If the oxygen level in the chlorine remains below 0.1% (V/V) very little corrosion of the graphite is observed whereas levels in excess of 1% (V/V) lead to severe corrosion in a matter of days. It is therefore highly desirable to maintain the oxygen level at or below 0.1%.

The discharge potential of oxygen, i.e. the standard electrode potential for $O_2$, is actually lower than that of chlorine (1.23 volts v. 1.36 volts). However, the great irreversibility of oxygen electrodes (i.e. the overpotential for oxygen) permits preferential evolution of chlorine despite these thermodynamic considerations. Thus, normally, chlorine is evolved preferentially although oxygen evolution is not entirely suppressed. The oxygen evolution reaction can be inhibited by maintaining a high acid concentration at the electrode reaction size. By maintaining the chloride ion concentration sufficiently high, chlorine discharge at the anode is facilitated.

The concentration of hydrochloric acid at any reaction site can be defined by the expression:

$$C_R = C_S - \frac{il}{FD}$$

where i = the cell current density

F = FARADAY

D = the HCl diffusion coefficient $C_S$ = the HCl concentration of the feed $C_R$ = the HCl concentration at the discharge site underneath the contact point between the electrode and the current collector l = the true diffusion path length for the HCl to the discharge site.

Thus it may be seen the the acid concentration at the reaction site, and hence the $O_2$ in $Cl_2$ level, is a function of both the diffusion path length and the feed stock acid concentration.

The discharge site below a contact element of the current collector has a longer diffusion path than do the sites below the liquid flow channel because the acid must diffuse laterally underneath the contact element and within and across the anode thickness to reach the electrode reaction site below a contact element, while the acid need only be diffuse across the anode thickness to reach the discharge site below the flow channel. Because of the greater path length, the acid concentration below the contact element is reduced and the rate of $O_2$ evolution tends to increase. By increasing the acid concentration of the feed, ($C_S$) the chloride ion content beneath the contact element is maintained sufficiently high to minimize oxygen evolution even though the area is partially obstructed or "blinded". Thus, it is customary to operate with anolyte acid feed concentration in excess of 10 M, preferably between 10 and 12 M to maintain the oxygen content in the chlorine at 0.1% or less.

While maintaining the feed stock acid concentration at very high levels is effective in reducing the oxygen evolution reaction, it has been found that it does have a number of shortcomings which make it less than an optimum solution. The problem is that the vapor pressure of hydrogen chloride, which is a gaseous material, is both a function of temperature and concentration. Its solubility in water is a logarithmic function of temperature. Operation of the cell at temperatures of 60° C. and above (which is desirable to minimize internal resistance, and electrode overpotential and maximize electrical efficiency) results in high hydrogen chloride partial pressures and impure chlorine product which must be purified. This expense is, of course, in addition to the undesirable corrosive effects of the hydrogen chloride on the cell and downstream equipment. If the operating temperature of the cell is reduced (i.e., to 30°–40° C.) in order to maintain the hydrogen chloride vapor pressure at a reasonable level, the overpotential of the electrodes and the internal ohmic loss increases and the power efficiency of the system decreases also resulting in higher chlorine production costs.

Thus, presently known techniques to minimize oxygen evolution in chlorine cells by increasing the acid feed stock concentration result in high hydrogen chloride vapor pressures; in an impure chlorine product, in added expense due to purification costs and in potential-corrosion of equipment. Attempts to control the hydrogen chloride vapor pressure when operating with a high feed acid concentration by reducing the temperature does reduce the vapor pressure, but results in a substantial penalty in cell voltage because internal resistance and the electrode overpotential increases as the temperature is reduced.

Applicant has now found that it is possible to electrolyze aqueous hydrogen chloride with low oxygen evolution levels (less than 0.1%), at high temperatures (60°-80° C.) with low hydrogen chloride vapor pressures (less than 0.1 of an atmosphere, i.e. 76 torr) by maintaining high chloride ion concentrations at the membrane electrode current collector contact area even with low feed acid concentration, i.e. acid concentration of less than 9 M and preferably 8.5 or 8 M or less.

Applicant has found that this may be achieved by minimizing the obstructed or "blinded" areas of the electrode and by maximizing diffusion of chloride to the "blinded" areas. To this end, a novel current collector construction is provided in which a array of contact elements are utilized in place of continuous parallel contact elements to establish a planar array of individual, unconnected current transfer areas, preferably in the plane of the electrode. The incoming anolyte is broken up into a plurality of intersecting anolyte streams which flow across the electrode surface. The turbulent flow due to the intersecting streams surround the point contact elements, and the increased perimeter exposed to anolyte permits diffusion of the acid anolyte to take place from all sides of the contact elements. This reduces the diffusion path length so that the ion chloride concentration beneath the contact may be maintained at a sufficiently high level to reduce oxygen evolution below 0.1% with feed acid concentrations of less than 9 molar. Because the cell is operated with lower feed acid concentrations, the cell may be operated at a much higher temperature (≦60° C.), without raising the hydrogen chloride vapor pressure to an undesirable level, (i.e. the vapor pressure is maintained at 0.1 atmosphere —76 torr or less). By operating at temperatures of 60° C. and above the cell voltage is substantially reduced because at these temperatures the electrode overpotential and ohmic losses are substantially reduced.

It is therefore a principal objective of this invention to provide a method and apparatus for electrolyzing aqueous halides in which coevolution of oxygen at the anode is minimized while operating at temperatures which maximize the cell efficiency.

Yet another objective of the invention is to provide a process for generating halogen from an aqueous hydrogen halide in which the vapor pressure of the halide is minimized at temperatures at which the cell is most efficient;

Yet another objective of the invention is to provide a process for generating chlorine from a hydrogen chloride with minimal coevolution of oxygen at low concentrations of the hydrogen halide anolyte;

Still another objective of the invention is to provide a cell for generating chlorine from aqueous hydrogen chloride in which the oxygen content of the chlorine is 0.1% or less and the hydrogen chloride vapor pressure is very low at cell operating temperatures of 60° C. or more;

Other objectives and advantages of the invention will become apparent as the description thereof proceeds.

In accordance with the invention, halogens such as chlorine, bromine and etc. are generated by the electrolysis of aqueous hydrogen halides at the anode of an electrolysis cell which includes an ion exchange membrane separating a cell into catholyte and anolyte chambers. A thin, porous, gas permeable catalytic anode is maintained in intimate contact with the ion exchange membrane bonding it to the surface of the ion exchange membrane. A graphite electron current conducting distributor which includes a planar array of conductive projections contacts the bonded electrode at a plurality of points either directly or through the medium of an interposed conductive screen. By virtue of the multipoint contact array configuration, turbulent flow is established over the electrode as the incoming anolyte is divided into in a plurality of intersecting streams. The multiple anolyte streams surround the contact elements and maximize diffusion of the anolyte beneath the surface and into contact with and into the chlorine evolving bonded electrode. In effect the diffusion path of the current conductor is decreased thereby maintaining the chloride ion concentration beneath the contacting element such that coevolution of oxygen is held at 0.1% by volume or less with low feed acid concentrations. The vapor pressure of the hydrogen chloride above the fluid is kept very low (less than 0.1 atmospheres) while operating the cell at 60° C. or above so that the overpotential of the electrode for chlorine evolution and separator resistance are minimized.

The novel features which are believed to be characteristic of the invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE DRAWINGS

Figure 1:
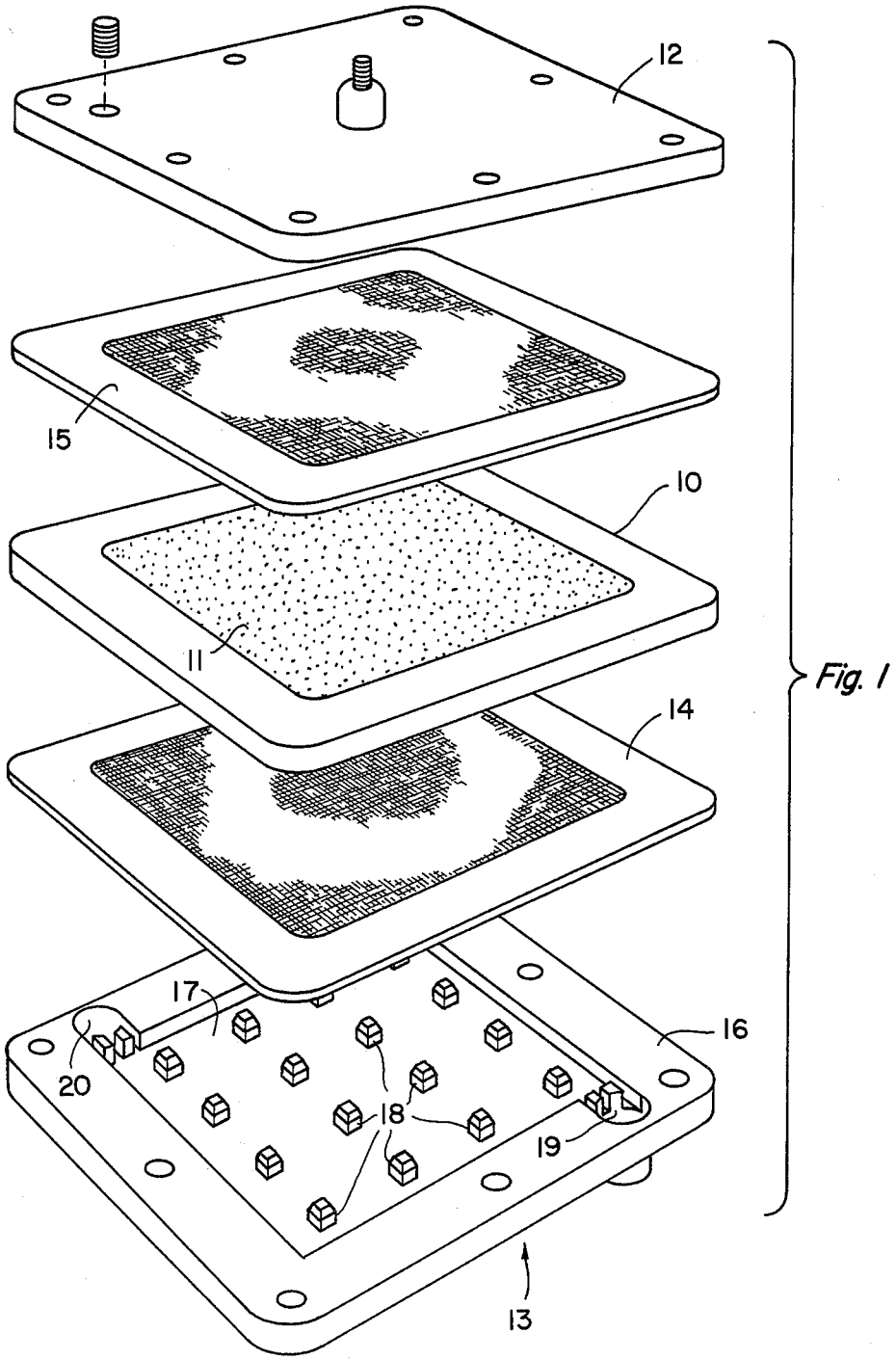
FIG. 1 is an exploded perspective view of an electrolyzer cell utilizing a novel current collector in which the processes to be described herein can be performed.

The cell assembly of FIG. 1 includes an ion transporting permselective membrane 10, preferably a cation permselective membrane, that separates the cell into anode and cathode chambers. A gas permeable cathode electrode 11, preferably in the form of a layer of electrocatalytic particles and particles of a polymeric binder such as polytetrafluoroethylene, is bonded to the upper surface of ion transporting membrane 10. A gas and liquid permeable anode, not shown, which may similarly be a mass of catalytic and polymeric particles, is bonded to and in intimate contact with the other side of membrane 10. The cell assembly is clamped between cathode current collecting end plate 12 and current collector 13 which are respectively connected to the terminals of the cell power supply. Although a single cell unit is shown for convenience, current collector 13 may be bipolar and used as a current conducting separator element between cell units. Niobium current distributing screen elements 14 and 15 are optionally positioned between membrane 10 and anode current collector fluid distributing element 13 and endplate 12 respectively. Collector 13 which is a molded graphite and fluorocarbon composite consists of a main body 16, a chamber 17 within the main body, and of an array of conductive contact elements 18 which contact either screen 15 or the anode electrode bonded to the underside of membrane 10. An inlet manifold 19 communicates with anode chamber 17 and a suitable inlet conduit to permit introduction of hydrochloric acid. An outlet conduit 20 also communicates with the anode chamber to permit the removal of spent anolyte as well as the gaseouselectrolysis product. Anode current collector/fluid distributor 13 serves two purposes, it provides a path for electrical current to reach the anode electrode bonded to the underside of membrane 10, and it forms the fluid containing and distributing path to hold the aqueous hydrochloric feed stack and the chlorine gas. Electrical contact to the bonded anode is made through the array of contact elements 18.

Figure 2:
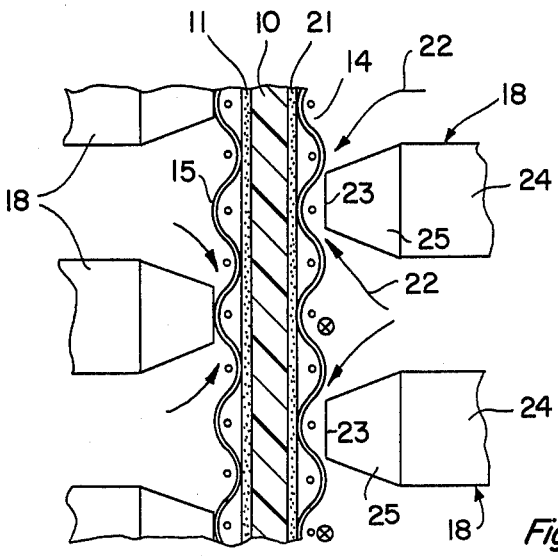
FIG. 2 is partial sectional view showing the membrane, electrode and a plurality of contact elements of the current collector.

As may be readily seen in FIG. 2, membrane 10 has a cathode electrode 11 bonded to one side and a anode electrode 21 bonded to the other. These electrodes are physically bonded to membranes so as to form a unitary membrane electrode construction. That is, the electrode is physically part of the membrane and conforms dimensionally and physically to the membrane during operation of the cell. The membrane is preferably a permselective cation transporting membrane such as those sold by the Dupont Company under trade designation Nafion. Nafion is a sulfonated perfluorinated membrane (i.e., hydrated copolymers of polytetrafluoroethylene and polysulfonyl fluoride vinyl ether with pendant sulfonic acid groups) and is readily available in various equilivalent weight and thicknesses. A ten mil thick Nafion 120 membrane, which has an equivalent weight of 1200, is perfectly adequate for use in the cell. The anode electrode is preferably a bonded aglomerate of catalytic particles, such as oxides of the platinum group metals i.e., ruthenium, iridium, paladium, etc., and a thermoplastic fluoropolymer such as Teflon to form a liquid and a gas permeable electrode structure. The preferred catalytic particles are reduced, temperature stabilized oxides of a platinum group metal such as ruthenium and or ruthenium and iridium in a suitable mixture. Reference is hereby made to U.S. Pat. No. 4,191,618, issued Mar. 4, 1980, and assigned to the General Electric Company, the assignee of the present invention, for a complete description of the manner of producing the catalytic electrode and attaching it to the membrane. Contact elements 18 are pressed firmly against screens 14 and 15 which are interposed between the contact elements and the bonded electrodes. The cathode and anode screens shown in FIGS. 1 and 2 are optional and contact elements 18 may be positioned directly against the electrodes. Screens are sometimes preferred because they distribute the current more evenly and also distribute the physical pressure on the electrodes more evenly so as to avoid corrugation or distortion of the membrane.

As may be seen in FIG. 2 the anolyte shown by the arrows 22 diffuses underneath contact surfaces 23 from all sides so that the anolyte diffuses rapidly to the surface of the anode electrode to maintain the desired chloride ion concentration such as to favor chlorine evolution.

Each contact element, as may be seen in FIG. 2 and in FIG. 1 consists of a square pedestal 24 which extends from the base of the anode chamber. The top of the pedestal is chamfered to form a truncated pyramid 25 which has the flat contact surface 23 which presses against the screen or against the electrode. Alternatively, the pedestal may be eliminated and the entire contact element may be in the form of a truncated pyramid.

The current collector is preferably a molded aggregate of conductive graphite particles and a thermoplastic fluoropolymer such as polyvinilidene flouride which is available from the Pennwalt Corporation under its trade name Kynar. Other fluoropolymer resins such as tetrafluoroethylene, etc. may be utilized with equal facility although polyvinilidene fluoride is preferable as it is a low cost material and has a lower molding temperature ($T=590°-630°$) than most other fluoropolymers. The conductive and resin particles in the aglomerate may be present in a weight ratio of between 2.5:1 and 16:1 and results in a structure having a bulk resistivity of $1-3.5\times10^{-3}$ ohm inches.

Figure 3:
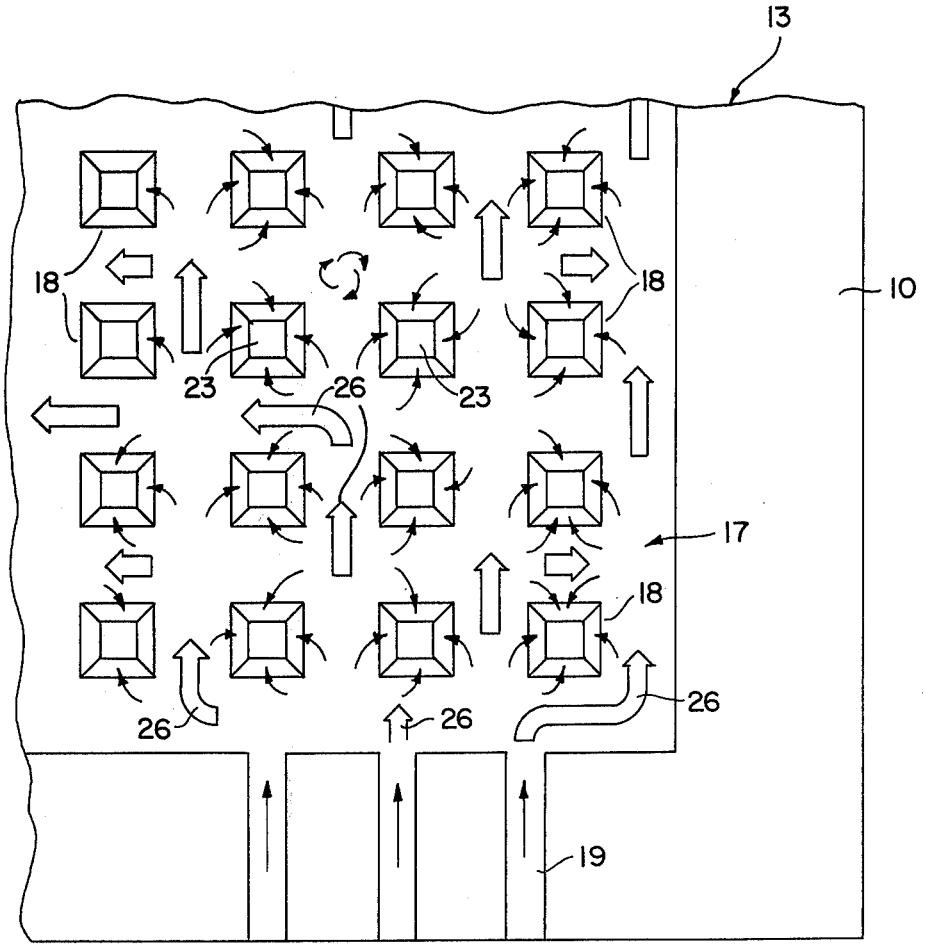
FIG. 3 is a plan view of the current collector and its planar array of contact elements illustrating the flow fields for the anolyte with the multiple contact array construction of the current collector.

FIG. 3 shows a partially broken away plan view of the bipolar current collector and fluid distributor. Inlet manifold 19 allows introduction of an anolyte, such as hydrochloric acid, into anode chamber 17. The array of conductive elements 18 projects from the base of the anode chamber, and as may be seen contact surfaces 23 form a planar array. The incoming anolyte stream shown by arrows 26 is broken up into a plurality intersecting fluid streams. Turbulent flow is established in the fluid paths and the anolyte flows on all four sides of contact elements 18 so that diffusion paths are established around the entire perimeter. This in effect, reduces the diffusion path length of the anolyte and produces the desired chloride ion concentration at the electrode even with anolyte concentrations or less than 9 M.

The geometry of the contact elements is such that the perimeter to area ratio is high and preferably in excess of a 100:1 for areas for which the contact area is 0.25 mils or less. The larger the ratio the more readily the anolyte is transported underneath the contact area thereby increasing the diffusive transport of HCl into the contact area and in effect reducing the diffusion path. A further advantage to an array of individual contact collectors is a greater degree of turbulence within the anode chamber. With a continuous rib geometry, flow of liquid and gas is constrained within the channels formed by the ribs and is essentially laminar flow; with the contact design such as shown in FIGS. 1 and 3 where there is an array of contacting elements, discontinuous in nature, a very large number of stream intersections are present which promote turbulent mixing and cavitation and result in a plurality of non-parallel i.e. intersecting streams which consequently minimize HCl depletion at the electrode surface directly beneath the contact elements.

EXAMPLES

Two cells were constructed which incorporated ion exchange membrane having cathodes and anodes bonded thereto. The cells were operated to electrolyze aqueous hydrogen chloride, to determine the effect of a multiple current conductor array in terms of oxygen content, hydrogen chloride vapor pressure, and cell voltage at various temperatures and feedstock concentrations. The cells were constructed with a 10 mil Nafion 120 membrane. The anode was a 100 micron thick particulate mass of temperature stabilized, reduced oxides of platinum group metals, specifically ruthenium (47.5% by weight) and iridium (5% by weight), mixed with the Teflon polytetrafluorethylene particles. The anode had an active area of 0.05 $ft^2$ and the loading was 4 miligrams/per $cm^2$ of the platinum group catalyst and 1.3 miligrams per $cm^2$ of the Teflon. The cathode was a platinum black Teflon mixture. Both cells were fitted with 5 Mil niobium anode collector screens. A current collector with an array of individual contact elements was incorporated in cell #1. The current collector was a compression molded graphite and 25% polyvinilidene fluoride (Kynar) structure with 506 elements spaced at 60 mil intervals. Each element had a 20 mils square contact area (0.02×0.02 in.). The pedestal was 60 mils and the overall height was 60 mils.

A second cell was then constructed identical to Cell #1 except that 17 continuous parallel ribs were employed as the contact element of the current collector. The ribs were beveled at the top to a 20 mil (0.020 inch) width with the ribs being 2614 mils (2.614 in.) in length. The cells were operated at a current density of 400 ASF with varying feed stock concentrations and at various temperatures to determine the oxygen content of the chlorine, the vapor pressures as well as the cell voltages. Table I illustrates the effect of varying temperature and concentration on the oxygen content, vapor pressure and cell voltage for Cell #2 utilizing the continuous parallel rib configuration for the current collector.

TABLE I

| Feed Conc. (Molar) | Temp (°C.) | Cell Voltage (volts) | $O_2$ Content (Vol. %) | HCl Vapor Press. (Torr) |
|---|---|---|---|---|
| 11.9 | 35° | 1.98 | 0.1 | 246 (.450 atmos) |
| 10.5 | 60° | 1.78 | 0.013 | 450 (0.6 atmos) |
| 7.9 | 60° | 1.78 | 0.41 | 30 (0.04 atmos.) |

As may be seen from Table I, a high HCl concentration 10.5 M and a high cell temperature, 60° C., results in a low $O_2$ content (less than 0.1%) and a cell voltage of 1.78. However, the vapor pressure of the hydrogen chloride under these conditions is 450 Torr or 0.6 of an atmosphere. It should be pointed out, that continuous boiling off of the hydrogen chloride also results in a reduction in the concentration and ultimately in an increase in the oxygen content. Maintaining the temperature constant at 60° C. but reducing the concentration to 7.9 M resulted in an increase in the voltage to 1.86 volts due to a concentration polarization potential at the contact points as chloride ions are depleted and water is electrolyzed. Furthermore, the oxygen content in the chlorine increased to 0.41%. Thus, while the vapor pressure was reduced by reducing the concentration of the feed stock, a penalty is paid in increases in the oxygen content as well as in the cell voltage because of the concentration polarization as the chloride ion content is depleted. Operating the cell at 35° C. using an 11.9 M hydrochloric acid feed stock reduces the oxygen content, but the vapor pressure even at this low temperature is in excess of 200 Torr and the cell voltage is increased to 1.98 volts. Thus, it can be seen that with a continuous rib configuration it is not possible to operate simultaneously with very low oxygen (less than 0.1%), high temperature (60°-80° C.) and with low hydrogen chloride vapor pressures (i.e. less than 0.1 atmosphere).

Cell #1 was then tested under various conditions to determine its operational characteristics at various concentrations, and temperatures to ascertain effects on cell voltage, oxygen content, and vapor pressure.

Table II shows the results.

TABLE II

| Feed Conc. (Molar) | Temp (°C.) | Cell Voltage (volts) | $O_2$ Content (Vol. %) | HCl Vapor Press. (Torr) |
|---|---|---|---|---|
| 10.3M | 36° | 1.90 | 0.1 | 60 (0.08 atmos.) |
| 8.4 | 60° | 1.75 | 0.01% | 55 (0.08 atmos.) |

At 60° C. and with an anolyte feed concentration of 8.4 M the cell voltage was 1.75 V, the oxygen content—0.01% and the hydrogen chloride vapor pressure—55 Torr (i.e. 0.08 atmospheres). Even at higher concentration and lower temperature performance is better than that of cell #1. Thus, it can be seen that with the point contact configuration the "blinding" of the electrode is minimized, oxygen evolution is reduced even with feed acid concentrations less than 9 M and even 8 M or less. Thus, it is possible to minimize oxygen content in the chlorine stream, (below 0.1%) at high temperatures 60° C. or more with the attendant improvement in cell voltage, while at the same time maintaining low hydrogen chloride vapor pressures (less than 0.1 atmosphere). The latter, of course, minimizes the cost associated with purification of the chlorine as well as avoiding or minimizing the corrosive action of the gaseous hydrogen chloride on the cell as well as equipment downstream from the cell.

It is apparent from the foregoing that at current densities up to 400 ASF, the oxygen content may be held below 0.1% (an $O_2$ level at which there is no observable corrosion of the graphite cell components); the cell temperature is 60° C. or greater and the HCl vapor pressure is at 76 Torr or less with aqueous HCl concentrations of less than 9 M and preferably 8 M or less. It will be obvious to the man skilled in the art that for any given current density above 400 ASF, the feed acid concentration must be such that chloride ion concentration is adequate to support the current density without evolving oxygen to an extent that $O_2$ content exceeds 1% and preferably does not exceed 0.1% and without increasing hydrogen chloride vapor pressure excessively.

It will be obvious from the foregoing that an improved process and apparatus for electrolyzing halides such as hydrochloric acid, has been described which minimizes oxygen coevolution with the chlorine, optimizes the cell voltage and minimizes boil off of hydrogen chloride gas by utilizing low concentrations of the acid feed stock.

While the instant invention has been shown with certain preferred embodiments thereof, the invention is by no means limited thereto since other modifications of the instrumentalities employed and of the steps of the process may be made and still fall within the scope of the invention. It is contemplated by the appended claims to cover any such modifications that fall within the true scope and spirit of this invention.

What is claimed as new and desired to be secured by Letters Patent of the United States is:

1. A process of generating halogens which comprises, (a) electrolyzing an aqueous halide between an anode and a cathode electrode separated by a permselective, liquid and gas impervious ion exchanging membrane, said anode being bonded to the membrane to provide a gas and liquid permeable electrode which forms part of a unitary electrode-membrane structure, (b) applying potential to the anode through a separate electron current conducting structure to introduce electron current flow to the bonded anode at a plurality of discrete areas on the surface of the anode, (c) establishing turbulent anolyte flow conditions over the surface of the anode to maintain the chloride ion concentration at the discrete areas of the anode at a level to minimize chloride ion starvation and oxygen evolution at the operating current density to maintain the oxygen content of the evolved halogen below 1%.

2. The process according to claim 1 wherein the oxygen content of the evolved halogen is maintained below 0.1%.

3. The process according to claim 1 wherein the aqueous halide anolyte is brought into contact with the anode over a plurality of intersecting fluid paths defined by the elements for introducing current to the anode to maximize the chloride ion concentration between the said elements and the discrete areas of the anode surface.

4. The process according to claim 3 wherein the oxygen content of the evolved halogen is maintained below 0.1% and the cell is operated at temperatures in excess of 60° C.

5. The process according to claim 4 wherein the halide vapor pressure in the evolved halogen is less than 0.1 atmosphere (76 Torr).

6. A process of generating chlorine which comprises, (a) electrolyzing aqueous hydrogen chloride between an anode and a cathode separated by liquid and gas impervious cation exchange membrane, with the anode being gas and liquid permeable and bonded to the membrane to form a unitary membrane and electrode structure, (b) applying potential to the cell and introducing electron current flow to the anode at a plurality of discrete, areas on the surface thereof through discrete conductive elements of a separate electron current conducting structure, (c) flowing the aqueous hydrogen chloride anolyte through said current conducting structure to establish a plurality of intersecting anolyte stream flowing on all sides ot the discrete elements to maximize diffusion of anolyte between the discrete elements to minimize oxygen evolution and maintain the oxygen content below 1%.

7. The process according to claim 6 wherein the oxygen content is maintained below 0.1% with the hydrogen chloride concentration less than 9 molar and the operating temperature in excess of 60° C.

8. The process according to claim 6 wherein the hydrogen chloride concentration is adequate to maintain the oxygen content below 0.1 percent and the vapor pressure below 0.1 atmospheres (76 Torr) at cell temperature of 60° C. or greater.

9. A halogen electrolysis unit (a) an anode and cathode chamber divided by an ion transporting membrane, (b) anode and cathode electrodes in the anode and cathode chambers with the anode bonded to the membrane to form a unitary anode-membrane structure, (c) a flow distributing, current collector positioned in the anode chamber, said current collector comprising a conductive plate, an array of discrete, conductive elements projecting from said plate to said anode to define a plurality of intersecting fluid flow paths, each of said conductive elements having contact surfaces to thereby form a planar array of contact surfaces for current conduction to the bonded anode, (d) means for establishing an electrical potential between the cathode and the anode through said current collector, (e) means to introduce an aqueous anolyte into the chamber to produce flow through said collector to break the anolyte into a plurality of intersecting streams which surround the conductive projections to maximize anolyte diffusion between the planar array of contact surfaces and the adjacent anode electrode areas and minimize oxygen evolution.

10. The cell according to claim 9 wherein the current collector is a molded graphite-polymer aggregate.

11. The cell according to claim 9 wherein a conductive element is interposed between the discrete, individual conductive projections and the anode bonded to the membrane.

12. The cell according to claim 9 wherein the ratio of perimeter to area of the contact area of each projection is at least 100 to 1.

13. The cell according to claim 10 wherein the planar contact area of each projection is the top of a truncated pyramid.

* * * * *